US008800850B2

(12) United States Patent
MacLeod

(10) Patent No.: US 8,800,850 B2
(45) Date of Patent: Aug. 12, 2014

(54) ARTICLE-TRANSPORT CONTAINER

(71) Applicant: TIN Inc., Memphis, TN (US)

(72) Inventor: Michael B. MacLeod, Romeoville, IL (US)

(73) Assignee: International Paper Co., Memphis, TN (US)

( * ) Notice: Subject to any disclaimer, the term of this patent is extended or adjusted under 35 U.S.C. 154(b) by 0 days.

(21) Appl. No.: 14/037,515

(22) Filed: Sep. 26, 2013

(65) Prior Publication Data

US 2014/0084047 A1 Mar. 27, 2014

Related U.S. Application Data

(60) Provisional application No. 61/705,692, filed on Sep. 26, 2012.

(51) Int. Cl.

| | |
|---|---|
| ***B65D 5/22*** | (2006.01) |
| ***B65D 5/44*** | (2006.01) |
| ***B65D 5/00*** | (2006.01) |
| ***B65D 5/20*** | (2006.01) |
| *B65D 21/032* | (2006.01) |

(52) U.S. Cl.

CPC ..... *B65D 5/2033* (2013.01); *B65D 5/443* (2013.01); *B65D 5/003* (2013.01); *Y10S 229/918* (2013.01)

USPC ..... 229/109; 229/174; 229/918

(58) Field of Classification Search

USPC ..... 229/109, 170, 171, 174, 191, 915, 918, 229/919

See application file for complete search history.

(56) References Cited

U.S. PATENT DOCUMENTS

| | | | | |
|---|---|---|---|---|
| 667,112 | A | | 1/1901 | Beers |
| 2,603,404 | A | | 7/1952 | Eldredge |
| 2,868,430 | A | | 1/1959 | Hamilton |
| 3,118,591 | A | | 1/1964 | Allard |
| 3,268,147 | A | * | 8/1966 | Karl-Hans ..... 229/191 |
| 3,310,219 | A | * | 3/1967 | Dlugopolski ..... 229/117.12 |
| 3,545,666 | A | | 12/1970 | Visvydas |
| 3,704,823 | A | | 12/1972 | Howe |
| 3,810,574 | A | | 5/1974 | Gardner |

(Continued)

FOREIGN PATENT DOCUMENTS

| | | |
|---|---|---|
| EP | 1764311 | 3/2007 |
| FR | 2669301 | 11/1990 |

(Continued)

*Primary Examiner* — Gary Elkins

(74) *Attorney, Agent, or Firm* — Matthew M. Eslamit; Brian K. Jarman

(57) ABSTRACT

An article-transport container comprises a floor having a respective left-side and right-side closures foldably joined thereto. A front end closure is foldably joined to the floor and to the respective right-side and left-side closures. A rear end closure is foldably joined to the floor and to the respective right-side and left-side closures. Four quad-layer corners are defined by a first quad-layer corner, a second quad-layer corner, a third quad-layer corner, and a fourth quad-layer corner which cooperate with the respective right-side and left-side closures to define an interior region adapted to receive articles therein. The first quad-layer corner includes respective outer and inner layers and respective first and second medial layers that are sandwiched between the respective outer and inner layers to enhance stacking strength of the container while minimizing scarps produced during construction of the container.

16 Claims, 7 Drawing Sheets

(56) References Cited

U.S. PATENT DOCUMENTS

| | | | | |
|---|---|---|---|---|
| 3,871,570 | A | 3/1975 | Garmon | |
| 4,537,344 | A | 8/1985 | Thomas | |
| 4,613,045 | A * | 9/1986 | Watson | 206/512 |
| 4,792,084 | A | 12/1988 | Dreeszen | |
| 4,883,221 | A | 11/1989 | Brundage | |
| 4,911,355 | A | 3/1990 | Bannister | |
| 5,052,615 | A | 10/1991 | Ott et al. | |
| 5,163,609 | A | 11/1992 | Muise, Jr. | |
| 5,289,970 | A | 3/1994 | McClure | |
| 5,295,623 | A | 3/1994 | Bacques et al. | |
| 5,330,094 | A * | 7/1994 | Mertz | 229/167 |
| 5,395,043 | A | 3/1995 | Bacques et al. | |
| 5,560,539 | A | 10/1996 | Baxter | |
| 5,752,648 | A | 5/1998 | Quaintance | |
| 5,913,474 | A | 6/1999 | Chu | |
| 5,979,746 | A | 11/1999 | McLeod et al. | |
| 6,302,323 | B1 | 10/2001 | Southwell | |
| 6,394,742 | B1 | 5/2002 | Buscema | |
| 6,481,619 | B1 | 11/2002 | Jackson | |
| 6,513,705 | B1 * | 2/2003 | Sheffer | 229/178 |
| 6,598,785 | B2 | 7/2003 | Quaintance | |
| 6,899,266 | B2 | 5/2005 | Conway | |
| 7,017,798 | B2 | 3/2006 | Pope et al. | |
| 7,470,226 | B1 | 12/2008 | Herrin | |
| 7,484,655 | B2 | 2/2009 | McLeod | |
| 7,665,654 | B2 | 2/2010 | McLeod | |
| 7,850,064 | B2 | 12/2010 | McLeod | |
| 8,091,770 | B2 | 1/2012 | McLeod | |
| 8,251,276 | B2 | 8/2012 | McLeod | |
| 8,408,452 | B2 | 4/2013 | Churvis et al. | |
| 2004/0149815 | A1 | 8/2004 | Holdsworth et al. | |
| 2005/0145687 | A1 | 7/2005 | Conway | |
| 2005/0236466 | A1 | 10/2005 | McLeod | |
| 2006/0213958 | A1 | 9/2006 | Valenzuela et al. | |
| 2006/0231603 | A1 | 10/2006 | McLeod | |
| 2009/0145955 | A1 | 6/2009 | McLeod | |
| 2009/0280973 | A1 | 11/2009 | Graham et al. | |
| 2010/0219232 | A1 | 9/2010 | Smith | |
| 2013/0186948 | A1 | 7/2013 | Hermosillo et al. | |

FOREIGN PATENT DOCUMENTS

| | | |
|---|---|---|
| GB | 2229426 | 9/1990 |
| WO | 2013090612 | 6/2013 |
| WO | 2013112348 | 8/2013 |

* cited by examiner

ARTICLE-TRANSPORT CONTAINER

CROSS REFERENCE TO RELATED APPLICATIONS

This application claims priority to US provisional patent application serial no. 61/705,692, filed on 26 Sep. 2012, which is hereby incorporated hereinto by reference as if fully restated herein.

FIELD OF THE INVENTION

The present disclosure relates to trays and containers, and particularly to trays and containers made of paperboard. More particularly, the present disclosure relates to a sturdy tray or container made of corrugated material and configured to contain food or other items.

BACKGROUND OF THE INVENTION

Containers made of paperboard, i.e., corrugated paperboard, are commonly used in the produce industry to pack, store and ship fresh produce. These containers typically have a bottom, opposite side walls, opposite end walls, and an open or partially open top, and when filled with fresh produce are placed on a pallet for shipping and handling. These containers have an inside minor flap which is divided, and shared with an outside full depth flap, to provide four additional corners in the same amount of material as other shipping containers. To enable the containers to be stacked on one another in stable relationship, they must have sufficient structural strength and rigidity to withstand the stacking forces. Thus, the side and/or end walls of the containers are usually constructed with multiple thicknesses, and/or additional reinforcing structure also may be provided, and the flutes of the corrugated material are typically arranged to extend vertically.

There is need for a paperboard container that is stackable, structurally rigid, and easy to set-up, reliably remains in set-up condition, and requires a minimum amount of material in its construction.

SUMMARY OF THE INVENTION

An article-transport container or tray is adapted to transport food or other articles from one site to another. The container includes a floor, a left-side closure, a right-side closure, a front end closure coupled to the floor and to the two side closures, and a rear end closure coupled to the floor and to the two side closures. These closures cooperate to form an interior article-receiving region.

In illustrative embodiments, the container further includes a first quad-layer corner formed between the front end closure and the right-side closure. The first quad-layer corner includes an outer layer formed from a portion of the right side closure, a first medial layer formed from another portion of the right side closure, a second medial portion formed from a portion of the front end closure, and an inner layer formed from another portion of the front end closure. The first medial layer is positioned to lie between the outer and second medial layers and is configured to provide means for interconnecting the outer layer and the second medial layer to cause stacking strength of the container to be improved while minimizing scrap produced during blank forming so that costs associated with producing the container are minimized.

In illustrative embodiments, the medial layer includes corrugation. The corrugation is arranged to extend horizontally parallel to the floor of the container.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 4 is a perspective view of the blank of FIG. 3 being folded to form the container showing that the rear end strip is folded about a rear-end fold line and at the same time both first and second rear anchor flaps included in the rear end strip are folded about associated anchor-flap fold lines toward the octagon-shaped floor so that the left and right side closures can be folded upwardly as suggested in FIG. 5;

FIG. 5 is a view similar to FIG. 4 showing continued forming of the container by folding a left corner bridge about a left corner-bridge fold line back onto a left corner tab so that the second medial layer and inner layer of the third quad-layer corner are established and by folding the right corner bridge about a right corner-bridge fold line back onto the right corner tab so that the second medial layer and inner layer of the fourth quad-layer corner are established;

FIG. 6 is a view similar to FIG. 5 showing continued forming of the container by folding the left side closure about the left-side fold line so that a portion of the second rear anchor flap is between a left side wall included in the left side panel and an interior region of the container and by folding the right side closure about a right-side fold line so that a portion of the first rear anchor flap is between the right side wall and the interior region of the container;

FIG. 7 is an enlarged partial view of the first quad-layer corner of the container of FIG. 6 showing continued forming of the container by folding the right side wall about the right side fold line so that the right side wall mates with the second bridge panel of the right corner bridge included in the front end strip and suggesting that the first wall anchor flap included in the inner strip mates with the first bridge panel of the right corner bridge included in the front end strip as suggested in FIG. 8;

FIG. 8 is a view similar to FIG. 7 showing continued forming of the container by folding the first primary and auxiliary canopy anchor flaps about a first primary flap fold line toward the floor to cause the first primary canopy anchor flap to mate with the front end wall as suggested in FIG. 9;

FIG. 9 is a view similar to FIG. 8 showing continued forming of the container by folding the first auxiliary canopy anchor flap about a first auxiliary flap fold line toward the right wall anchor flap to mate with the right wall anchor flap as suggested in FIG. 10;

FIG. 10 is a view similar to FIG. 9 showing completed forming of the container and formation of the first quad-layer corner as a result;

FIGS. 11-13 show how the blank of FIG. 3 can be varied to produce a container characterized by each quad-layer corner having a first medial layer that extends partially between the right side wall and the front end wall when the container is formed;

FIG. 11 shows a portion of a blank in accordance with a second embodiment of the present disclosure;

FIG. 12 is a view similar to FIG. 10 following folding of a first auxiliary canopy anchor flap towards a first right wall anchor flap trapping the first right wall anchor flap between the first auxiliary canopy anchor flap and a first bridge panel of the right corner bridge causing a quad-layer corner to be established; and FIG. 13 is a section view taken along line 13-13 of FIG. 12 showing that the front-right quad-layer corner included in the article-transport container includes, from outside in, an outer layer formed by the first auxiliary canopy anchor flap, a first medial layer formed by the first right wall anchor flap, a second medial layer formed by the first bridge panel of the right corner bridge, and an inner layer formed by the second tab panel included in the right corner tab and showing that the first right wall anchor flap is arranged to lie between the second medial layer and the outer layer and is arranged to extend partially between the right side wall and the front end wall.

DETAILED DESCRIPTION OF THE INVENTION

Figure 1:
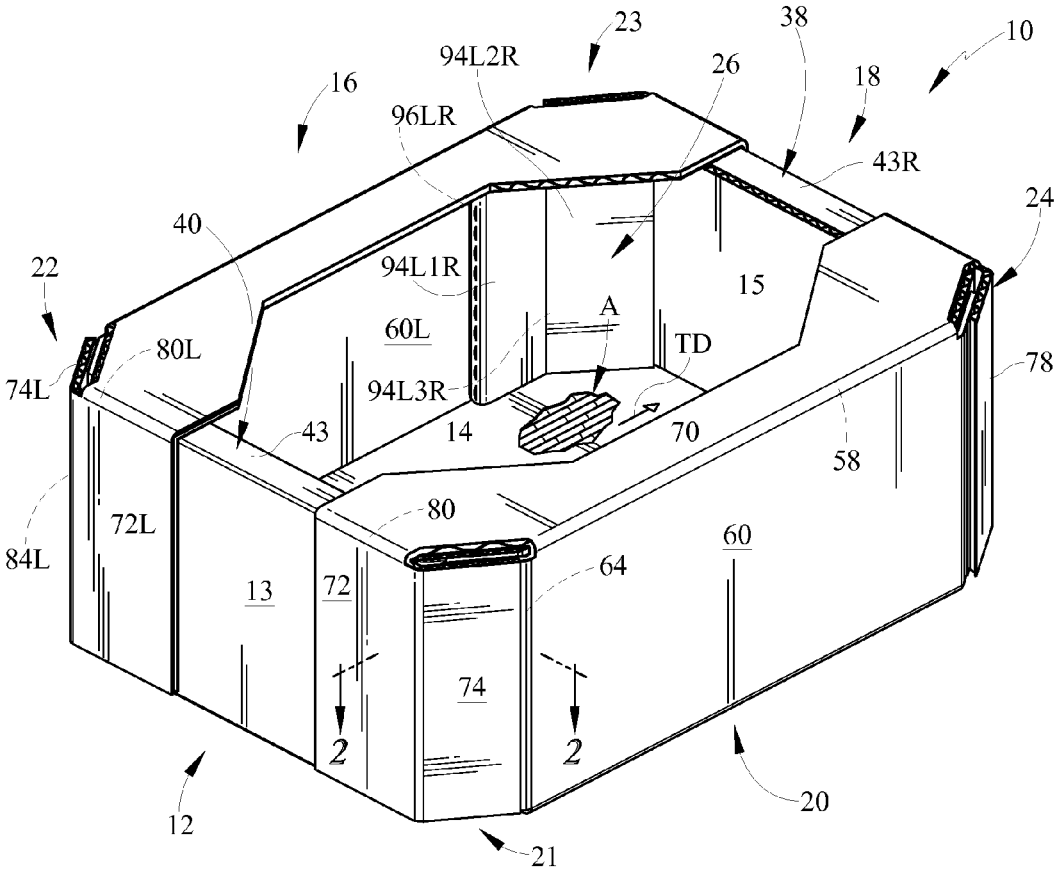
FIG. 1 is a perspective view of an erected article-transport container with four quad-layer corners in accordance with a first embodiment of the present disclosure showing that the article-transport container includes (on the lower left) a front end wall coupled to a left side closure (on the left side) including a horizontal left canopy and a right side closure (on the right side) including a horizontal right canopy and a rear end wall coupled to the left and right side closures.
Figure 2:
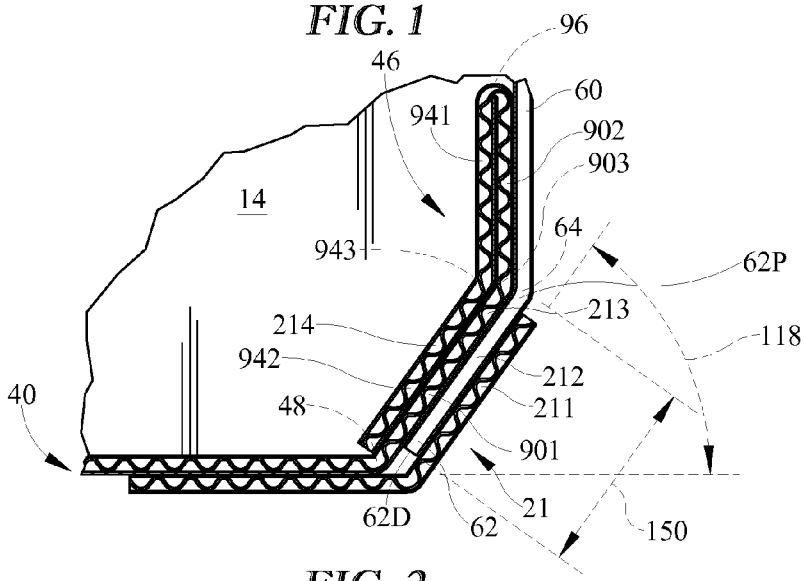
FIG. 2 is a sectional view taken along line 2-2 of FIGS. 1 and 10 showing that a first quad-layer corner included in the article-transport container includes, from outside in, an outer layer in which the corrugation is oriented vertically, a first medial layer in which the corrugation is oriented horizontally, a second medial layer in which the corrugation is oriented vertically, and an inner layer in which the corrugation is oriented vertically.
Figure 11:
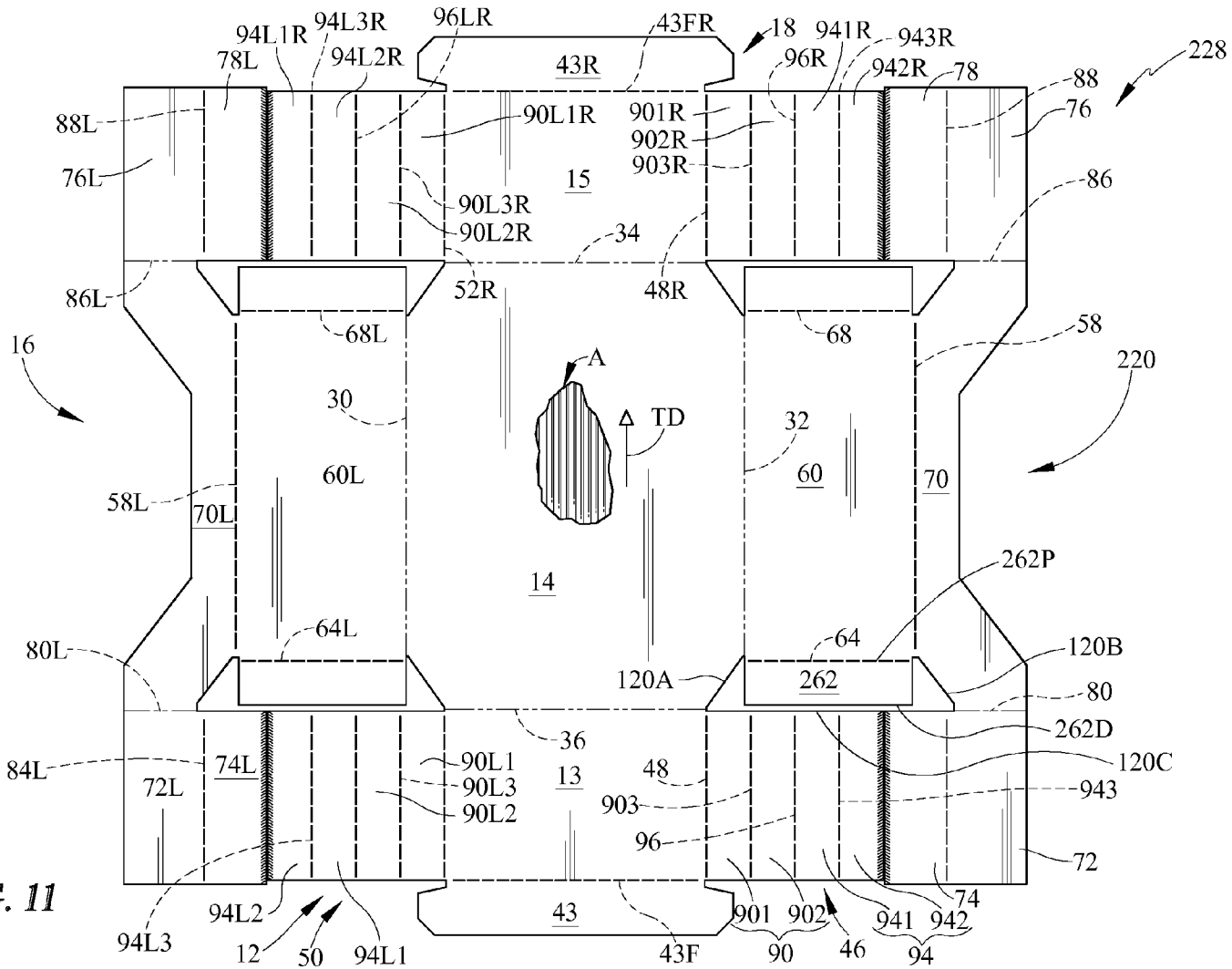
Figure 12:
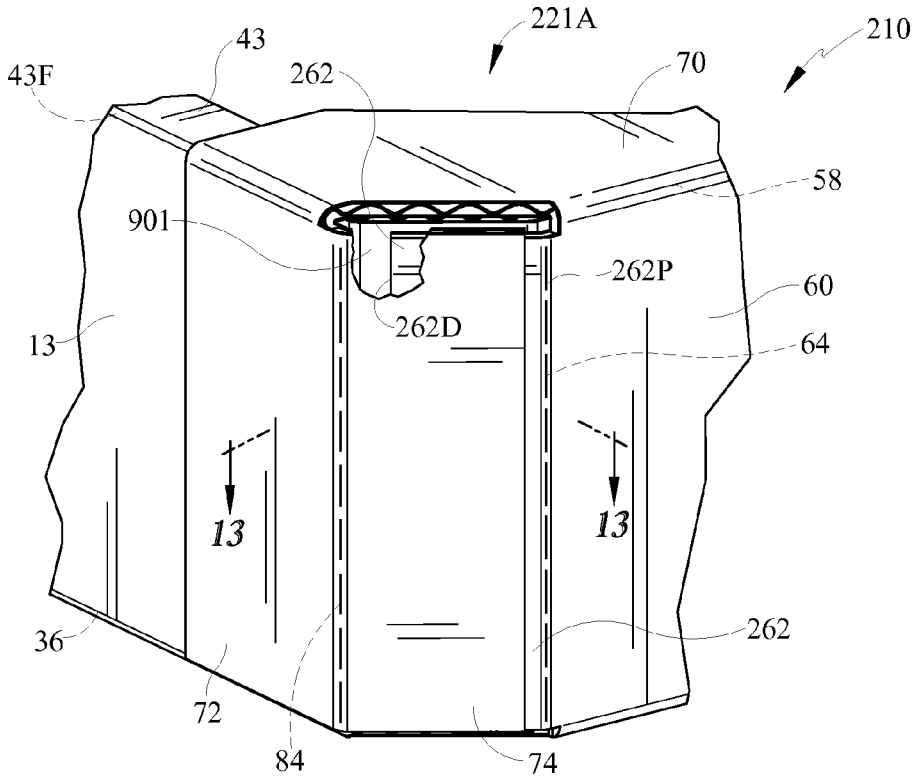
Figure 13:
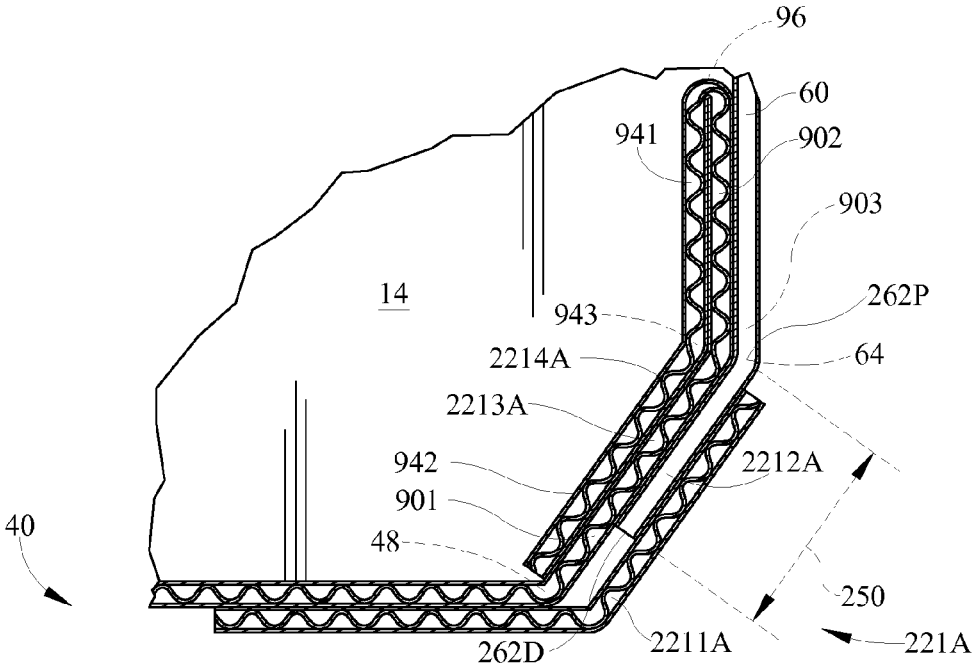

An erected article-transport container 10 in accordance with the present disclosure is shown in FIG. 1. Article-transport container 10 includes four quad-layer corners 21, 22, 23, 24 in accordance with a first embodiment of the present disclosure and first quad-layer corner 21 is shown in FIG. 2. Article-transport container 10 includes, in series starting in the front left, a front end closure 12 coupled to a floor 14 included in container 10, a left side closure 16 coupled to floor 14 and including a left canopy 70L overlying floor 14, a rear end closure 18 coupled to floor 14, and a right side closure 20 coupled to floor 14 and including a right canopy 70 overlying floor 14. Front end closure 12, left side closure 16, rear end closure 18, right side closure 20, floor 14, and quad-layer corners 21, 22, 23, 24 cooperate to define an interior region 26 therebetween that is adapted to receive articles (not shown) therein. Another embodiment of a quad-layer corner 221A is shown in FIGS. 11-13.

Quad-layer corners 21, 22, 23, 24 cooperate to provide means for increasing stack strength of container 10 while simplifying blank forming and minimizing scrap produced during blank forming. As an example, first quad-layer corner 21 includes an outer layer 211, a first medial layer 212, a second medial layer 213, and an inner layer 214 as shown in FIG. 2. First medial layer 212 is positioned to lie between second medial layer 213 and outer layer 211. Second medial layer 213 is positioned to lie between first medial layer 212 and inner layer 214. First medial layer 212 is configured to provide means for interconnecting outer layer 211 to second medial layer 213 to cause stack strength of container 10 to be improved while minimizing scrap produced during blank forming so that costs associated with producing container 10 are minimized.

Figure 3:
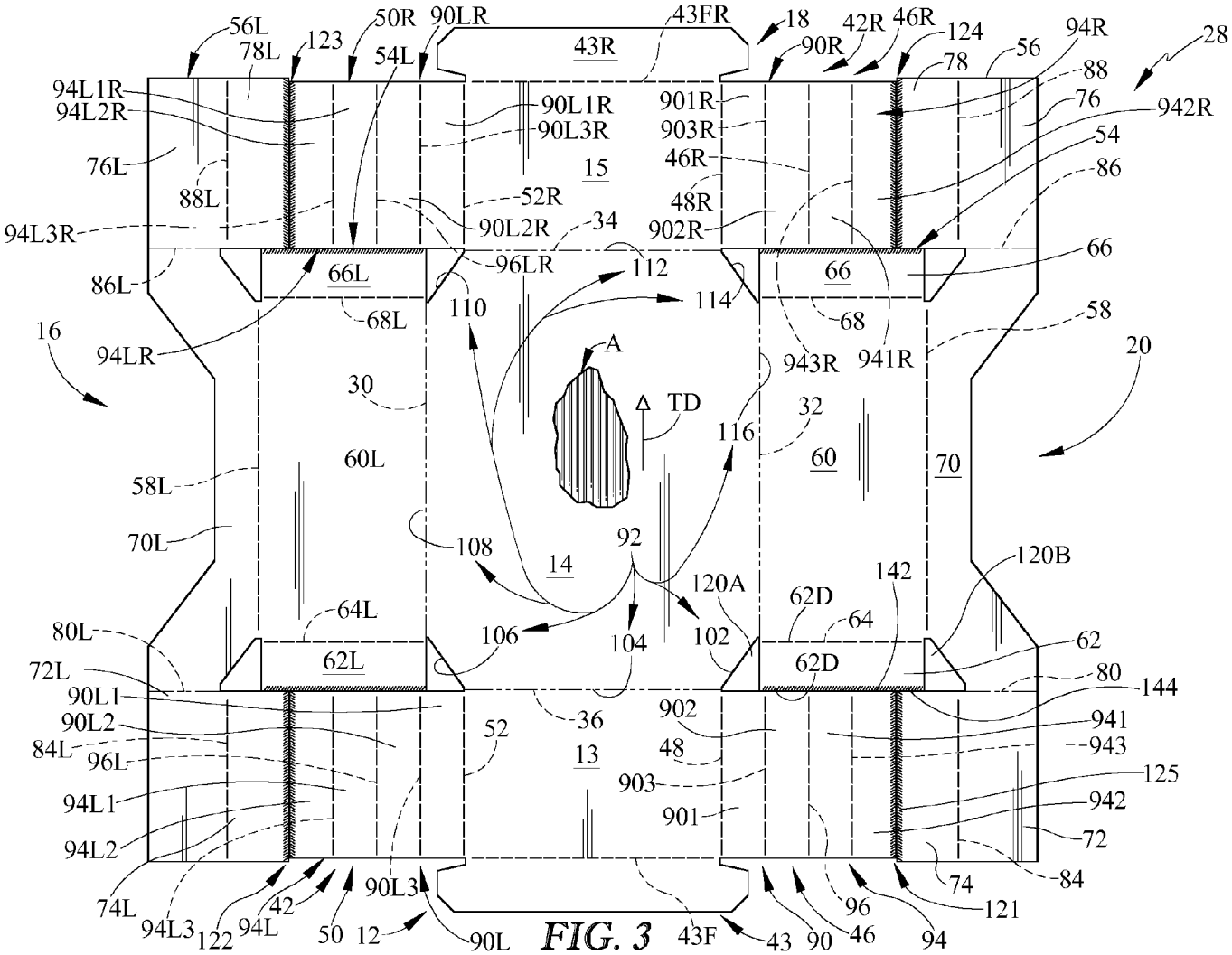
FIG. 3 is a plan view of a blank of corrugated material used to form the container of FIG. 1 and showing that the blank includes an octagon-shaped floor, a left side closure coupled to the floor (at the left of the page), a rear end closure (at the top of the page), a right side closure (at the right of the page) comprising, from left to right, a right inner strip including, from top to bottom, a second wall anchor flap, a right side wall coupled to the floor, and a first wall anchor flap that forms the first medial layer of the first quad-layer corner and a right outer strip including, from top to bottom, a second auxiliary canopy anchor flap, a second primary canopy anchor flap, a right canopy coupled to the right side wall, a first primary canopy anchor flap, and a first auxiliary canopy anchor flap forming the outer layer of the first quad-layer corner, and a front end strip (at the bottom of the page) including, from left to right, a second front anchor flap, a front end wall coupled to the floor, and a first front anchor flap including a right corner bridge including a first bridge panel that forms the second medial layer of the first quad-layer corner and a second bridge panel and a right corner tab including a first tab panel and a second tab panel that forms the inner layer of the first quad-layer corner and a front end canopy coupled to the front end wall.

Container 10 is made from a blank 28 after blank 28 is formed in a blank-forming process. As shown in FIG. 3, blank 28 includes floor 14, left side closure 16 appended to floor 14 along a left-side fold line 30, right side closure 20 appended to floor 14 along a right-side fold line 32, rear end closure 18 appended to floor 14 along a rear-end fold line 34, and front end closure 12 appended to floor 14 along a front-end fold line 36. Right side closure 20, left side closure 16, rear end closure 18, front end closure 12, and quad-layer corners 21, 22, 23, 24 cooperate to form a border coupled to floor 14 and arranged to cooperate with floor 14 to define interior region 26 of container 10.

Rear end closure 18 cooperates with left side closure 16 and right side closure 20 to establish a rear end 38 of container 10 as shown in FIG. 1. Front end closure 12 cooperates with left side closure 16 and right side closure 20 to establish a front end 40 of container 10 as shown in FIG. 1. It is within the scope of the present disclosure to make blank 28 from a variety of materials including corrugated paperboard, folding carton, and solid fiber and other materials such as plastic sheeting and corrugated plastic.

Figure 4:
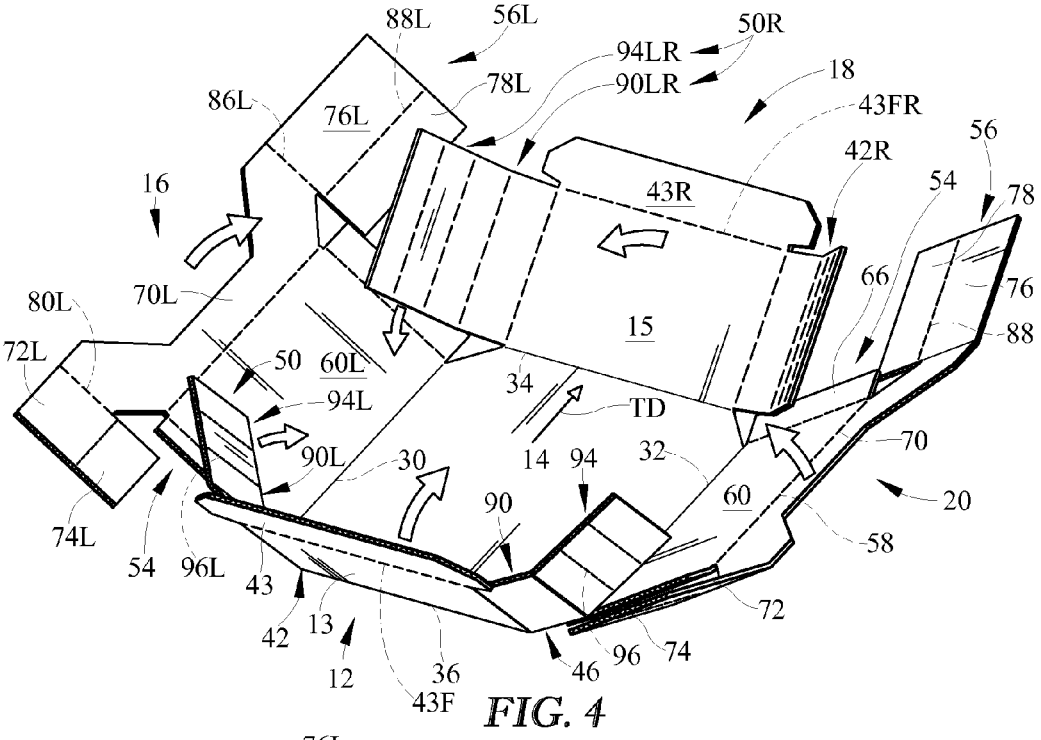
FIGS. 4-11 are a series of views showing a method of forming the article-transport container of FIG. 1 using the blank of FIG. 3.

Article-transport container 10 is established as result of passing blank 28 through a container-forming process shown, for example, in FIGS. 4-10. As shown in FIG. 3, blank 28 includes floor 14, front end closure 12 coupled to floor 14 along front-end fold line 36, left side closure 16 coupled to floor 14 along left-side fold line 30, rear end closure 18 coupled to floor 14 along rear-end fold line 34, and right side closure 20 coupled to floor 14 along right-side fold line 32 as shown in FIG. 4.

Figure 6:
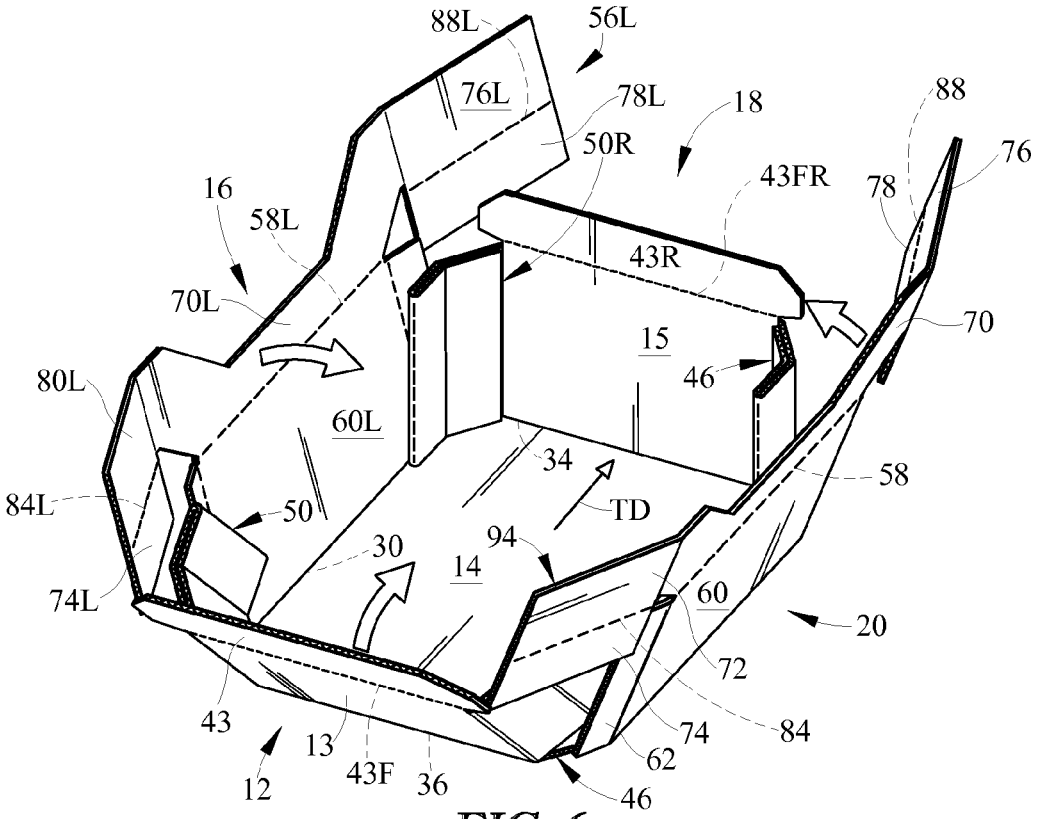

Front end closure 12 illustratively includes a front end strip 42 and a front end canopy 43 coupled to front end strip 42 about a front end canopy fold line 43F as shown in FIG. 3. Front end strip 42 includes front end wall 13, a first front anchor flap 46 coupled to front end wall 13 about a first front anchor-flap fold line 48, and a second front anchor flap 50 coupled to front end wall 13 about a second front anchor-flap fold line 52 as shown in FIG. 3. First front anchor flap 46 is positioned to lie in spaced-apart relation to second front anchor flap 50 to locate front end wall 13 therebetween. As shown in FIGS. 2 and 6, portions of first front anchor flap 46 are used to establish second medial layer 213 and inner layer 214 of first quad-layer corner 21. Similarly, portions of second front anchor flap 50 are used to establish second medial layer 223 and inner layer 224 of second quad-layer corner 22.

First front anchor flap 46 includes a front right corner bridge 90 that is coupled to front end wall 13 about a first front anchor-flap fold line 48 and a front right corner tab 94 that is coupled to front right corner bridge 90 about a first front corner-tab fold line 96 as shown in FIG. 3. Second medial layer 213 and inner layer 214 of first quad-layer corner 21 are established during an initial stage of container forming as suggested in FIGS. 4-10.

Front right corner bridge 90 includes a first bridge panel 901 and a second bridge panel 902 as shown, for example, in FIG. 3. First bridge panel 901 is coupled to front end wall 13 by first front anchor-flap fold line 48. Second bridge panel 902 is coupled to first bridge panel 901 by a bridge-panel fold line 903. Front right corner tab 94 is coupled to second bridge panel 902 by first front corner-tab fold line 96. First bridge panel 901 establishes second medial layer 213 as shown in FIG. 2.

Front right corner tab 94 includes a first tab panel 941 and a second tab panel 942 as shown in FIG. 3. First tab panel 941 is coupled to second bridge panel 902 by first front corner-tab fold line 96. Second tab panel 942 is coupled to first tab panel 941 by a tab-panel fold line 943. Second tab panel 942 establishes inner layer 214 as shown in FIG. 2.

Figure 5:
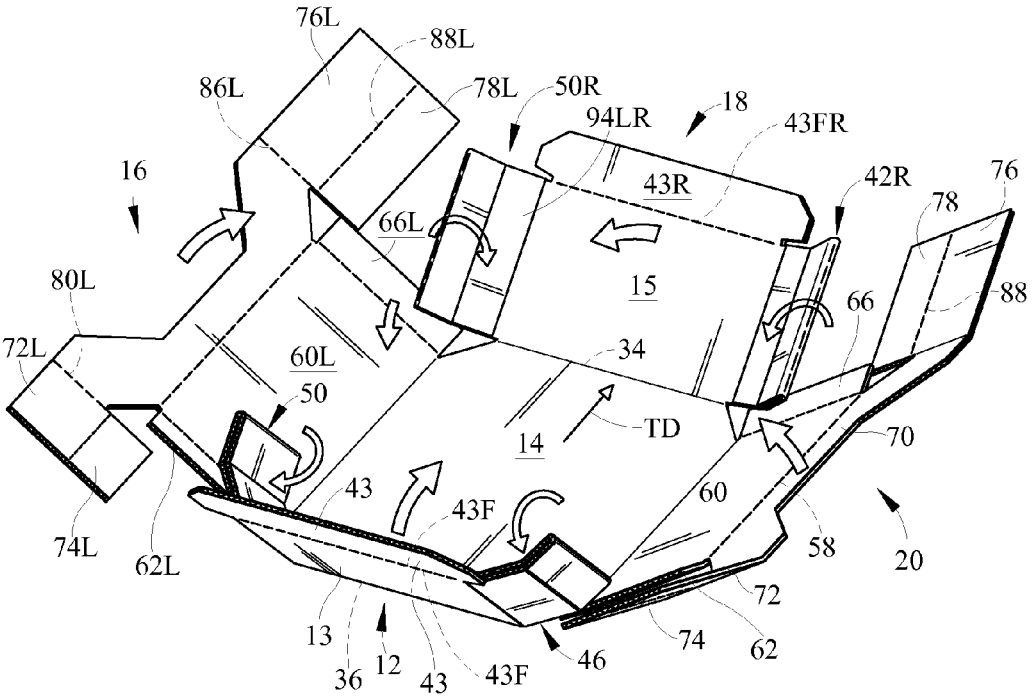

During the initial stage of container formation, front end closure 12 is folded about front-end fold line 36 toward floor 14. At the same time, front right corner bridge 90 is folded inwardly toward floor 14 about first front anchor-flap fold line 48 and front right corner tab 94 is folded inwardly toward floor 14 about first front corner-tab fold line 96 as shown in FIG. 4. Next, first right corner tab 94 is folded back toward front right corner bridge 90 along first front corner-tab fold line 96 to cause first tab panel 941 to lie in confronting relation with second bridge panel 902 and second tab panel 942 to lie in confronting relation with first bridge panel 901 as shown in FIG. 5. As a result, front end strip 42 is arranged to extend upwardly away from floor 14 and second bridge panel 902 is arranged to extend along right-side fold line 32. First bridge panel 901 is arranged to extend between and interconnect second bridge panel 902 and front end wall 13.

Right side closure 20 illustratively includes a right inner strip 54 coupled to floor 14 about right-side fold line 32 and a right outer anchor strip 56 coupled to right inner strip 54 about a right anchor-strip fold line 58 as shown in FIG. 3. Right inner strip 54 includes, for example, a right side wall 60, a first right wall anchor flap 62 coupled to right side wall 60 about a first right wall flap fold line 64, and a second right wall anchor flap 66 coupled to right side wall 60 about a second right wall flap fold line 68 as shown in FIG. 3. First right wall anchor flap 62 is used to establish first medial layer 212 of first quad-layer corner 21. First medial layer 212 of first quad-layer corner 21 is established during a subsequent stage of container forming as suggested in FIGS. 4-10.

During the subsequent stage of container forming, right side closure 20 is folded about right-side fold line 32 toward floor 14 so that right side wall 60 and first and second right wall anchor flap 62, 66 extend upwardly away from floor 14 as shown in FIG. 6. At the same time, first and second right wall anchor flaps 62, 66 are folded inwardly toward floor 14 about associated right wall flap fold lines 64, 68. As an example, first right wall anchor flap 62 is arranged to extend away from right side wall 60 toward front end wall 13 and is coupled to first bridge panel 901 of front right corner bridge 90 and forms first medial layer 212 as shown in FIGS. 2 and 7.

Right outer anchor strip 56 includes a right canopy 70, a first right primary canopy anchor flap 72, a first right auxiliary canopy anchor flap 74, a second right primary canopy anchor flap 76, and a second right auxiliary canopy anchor flap 78 as shown in FIG. 3. Right canopy 70 is coupled to right side wall 60 about right anchor-strip fold line 58. First right primary canopy anchor flap 72 is coupled to right canopy 70 by a first right primary flap fold line 80. First right auxiliary canopy anchor flap 74 is coupled to first right primary canopy anchor flap 72 by a first right auxiliary flap fold line 84 as shown in FIG. 3. Second right primary canopy anchor flap 76 is coupled to right canopy 70 by a second right primary flap fold line 86. Second right auxiliary canopy anchor flap 78 is coupled to second right primary canopy anchor flap 76 by a first right auxiliary flap fold line 88 as shown in FIG. 3. Outer layer 211 of first quad-layer corner 21 is established during a last stage of container forming as suggested in FIGS. 9 and 10.

During the last stage of container forming, right outer anchor strip 56 is folded about right anchor-strip fold line toward floor 14 so that right canopy 70 is arranged to lie in spaced-apart parallel relation above floor 14 as shown in FIG. 2. At the same time, first right primary and auxiliary canopy anchor flaps 72, 74 are folded downwardly about first right primary flap fold line 80 so that first right primary canopy anchor flap 72 extends downwardly and mates with front end wall 13 as suggested in FIG. 8 and shown in FIG. 9. Finally, first quad-layer corner 21 is established as a result of folding first right auxiliary canopy anchor flap 74 about first right auxiliary flap fold line 84 toward first right wall anchor flap 62 as suggested in FIG. 9 and shown in FIG. 10.

Figure 7:
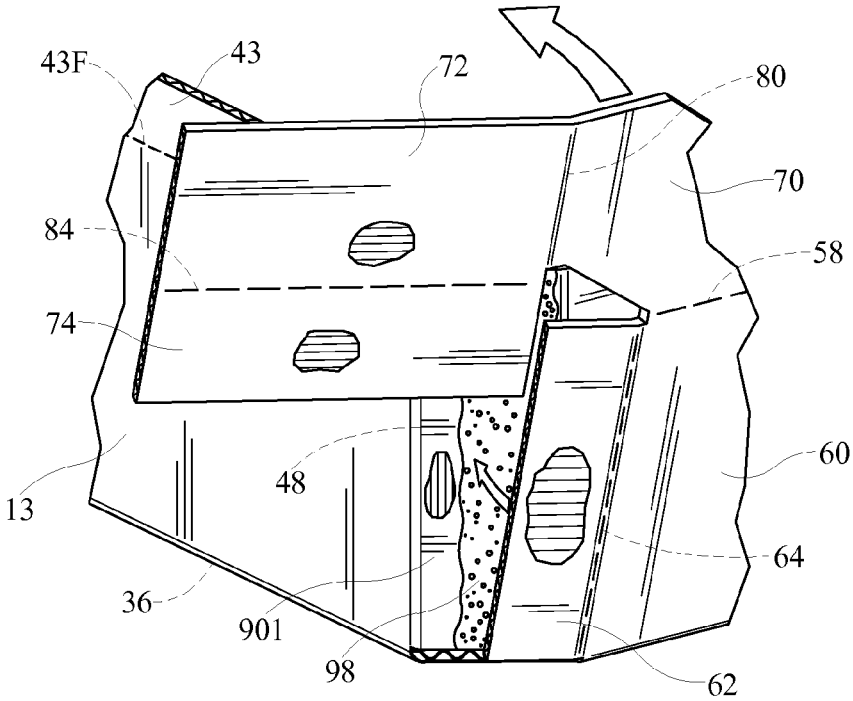
Figure 8:
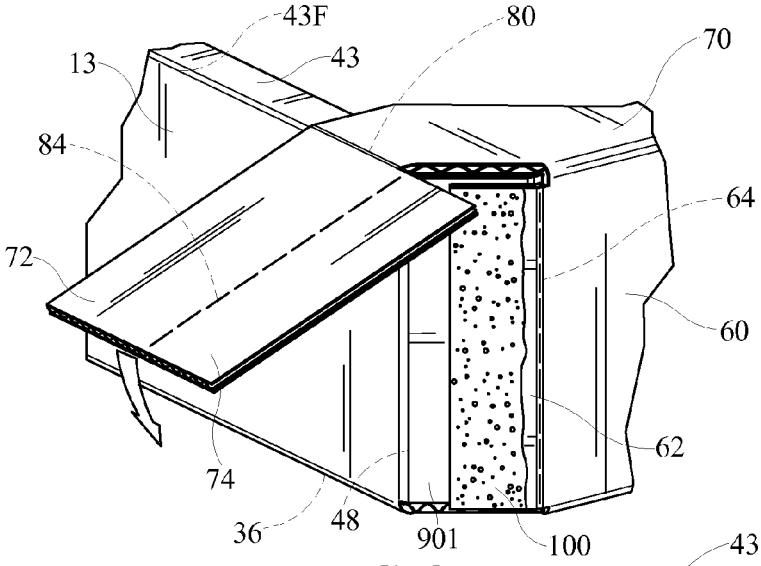
Figure 9:
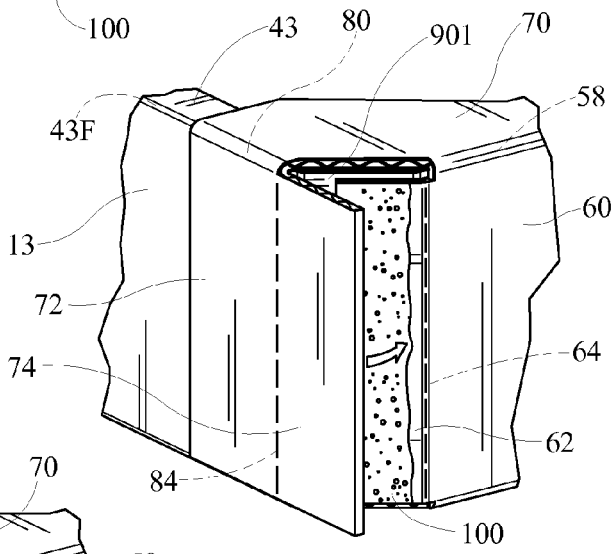

First quad-layer corner 21 is established as a result of coupling first right wall anchor flap 62 to first bridge panel 901 of front right corner bridge 90 and by coupling first right auxiliary canopy anchor flap 74 to first right wall anchor flap 62 as shown in FIGS. 6-10. As an example, first right wall anchor flap 62 is coupled to first bridge panel 901 by adhesive 98 as shown in FIG. 7. First right auxiliary canopy anchor flap 74 is coupled to first right wall anchor flap 62 by adhesive 100 as shown in FIGS. 8 and 9. While adhesive 98, 100 is shown as an example, any other suitable alternative may be used.

In an illustrative embodiment, the corrugation of blank 28 is positioned to run in a transverse direction TD as shown in insert A in FIGS. 1 and 3. As a result, outer layer 211, second medial layer 213, and inner layer 214 of quad-layer corners 21, 22, 23, 24 have corrugation which runs vertically as shown in FIGS. 3 and 7 after container 10 has been formed. First medial layer 212 has corrugation which runs horizontally as shown in FIG. 6 after container 10 has been formed.

In one illustrative example, it was found surprisingly that the first medial layers of quad-layer corners 21, 22, 23, 24 increases stacking strength of container 10 as compared to those containers lacking first medial layer 212. Stacking strength may be measured using standard industry test methods. As an example, stacking strength may be evaluated using the TSL-8.2-WI-005 test method and procedure reference T804 of the Technical Association of the Pulp and Paper Industry (TAPPI).

As illustrated in FIG. 3, floor 14 has an octagon shape that includes in series, a first mitered edge 102, a front end edge 104, a second mitered edge 106, a left edge 108, a third mitered edge 110, a rear end edge 112, a fourth mitered edge 114, and a right edge 116. As an illustrative example, left and right edges 108, 116 have lengths greater than lengths of front and rear end edges 104, 112. Front and rear end edges 104, 112 have lengths greater than first, second, third, and fourth mitered edges 102, 106, 110, 114. Edges 102, 104, 106, 108, 110, 112, 114 cooperate to define a floor perimeter 92 as shown in FIG. 3.

First quad-layer corner 21 is arranged to extend between front end wall 13 and right side wall 60 and lie at an angle 118 relative to front end wall 13 as shown in FIG. 2. Angle 118 is defined to be between first mitered edge 102 of floor 14 and front end edge 104 of floor 14. As shown in FIG. 2, angle 118 is illustratively an acute angle. Inner layer 214 of quad-layer corner 21 is positioned to lie inside floor perimeter 92 and is arranged to extend between front end edge 104 and right edge 116 and between floor 14 and right canopy 70. First medial layer 212 is positioned to lie outside floor perimeter 92 is and is arranged to extend along first mitered edge 102 so that first medial layer 212 lies at angle 118. Outer layer 211 is positioned to lie outside floor perimeter 92 and is arranged to lie in spaced-apart relation to first mitered edge 102 to cause first medial layer 212 to lie there between.

Blank 28 is formed during an illustrative blank forming process in which a corrugated sheet is processed to establish blank 28 and scrap which is separated from blank 28. During blank forming, first right wall anchor flap 62 is formed to have a proximal end 62P and a distal end 62D which is spaced-apart from proximal end 62P. First right wall anchor flap 62 is appended to right side wall 60 along first right wall flap fold line 64 by proximal end 62P. As shown in FIG. 3, first right wall anchor flap 62 extends away from first right wall flap fold line 64 toward first front anchor flap 46 and first right auxiliary canopy anchor flap 74 such that distal end 62D abuts first front anchor flap 46 and first right auxiliary canopy anchor flap 74. Distal end 62D is separated from first front anchor flap 46 and first right auxiliary canopy anchor flap 74 by a cut line 142 as shown in FIG. 3.

During blank forming, scrap is separated from blank 28 which causes two triangle-shaped apertures 120A, 120B to be formed therein. As a result of distal end 62D of first right wall anchor flap 62 abutting first front anchor flap 46 and first right auxiliary canopy anchor flap 74, friction is developed during container forming as front end strip 42 is folded upwardly about front-end fold line 36. A first right-wall anchor-flap crush area 144 is established during blank forming to provide means for minimizing friction developed between first right wall anchor flap 62 and first front anchor flap 46 and first right auxiliary canopy anchor flap 74 during container forming so that the likelihood of creating improperly formed containers is minimized.

Also during blank forming, a first crush area 121 is formed in blank 28. First crush area 121 is configured to provide means for minimizing friction developed between front right corner tab 94 and first right auxiliary canopy anchor flap 74 during container forming as front right corner tab 94 of front end strip 42 is folded upwardly about front-end fold line 36. Second, third, and fourth crush areas 122, 123, 124 are also formed.

First, second, third, and fourth crush areas 122, 123, 124 are substantially similar to first crush area 121, and thus, only first crush area 121 will be discussed in detail. First crush area 121 is established along a cut line 125 formed between front right corner tab 94 and first right auxiliary canopy anchor flap 74 as shown in FIG. 3. A rate of container forming may be increased as a result of minimizing friction which decreases the likelihood of improperly forming containers. These improperly formed containers are also called as cripples. Blank 28 and resulting container 10 minimize waste because the number of improperly formed containers is minimized.

Second quad-layer corner 22 is formed during container forming by folding front end closure 12 and left side closure 16 so that second quad-layer corner 22 is established as a result as suggested in FIGS. 4-6. A portion of second front anchor flap 50 establishes an inner layer 224 of second quad-layer corner 22.

Second front anchor flap 50 includes a front left corner bridge 90L that is coupled to front end wall 13 about a second front anchor-flap fold line 52 and a front left corner tab 94L that is coupled to front left corner bridge 90L about a second front corner-tab fold line 96L as shown in FIG. 3. Second medial layer 223 and inner layer 224 of second quad-layer corner 22 are established during the initial stage of container forming as suggested in FIGS. 4-10.

Front left corner bride 90L includes a first bridge panel 90L1 and a second bridge panel 90L2 as shown, for example, in FIG. 3. First bridge panel 90L1 is coupled to front end wall 13 by second front anchor-flap fold line 52. Second bridge panel 90L2 is coupled to first bridge panel 90L1 by a bridge-panel fold line 90L3. Front left corner tab 94L is coupled to second bridge panel 90L2 by second front corner-tab fold line 96L. First bridge panel 90L1 establishes second medial layer 223.

Front left corner tab 94L includes a first tab panel 94L1 and a second tab panel 94L2 as shown in FIG. 3. First tab panel 94L1 is coupled to second bridge panel 90L2 by second front corner-tab fold line 96L. Second tab panel 94L2 is coupled to first tab panel 94L1 by a tab-panel fold line 94L3. Second tab panel 94L2 establishes inner layer 224 as shown in FIG. 2.

During the initial stage of container formation, front end closure 12 is folded about front-end fold line 36 toward floor 14. At the same time, front left corner bridge 90L is folded inwardly toward floor 14 about second front anchor-flap fold line 52 and front left corner tab 94L is folded inwardly toward floor 14 about second front corner-tab fold line 96L. Next, first left corner tab 94L is folded back toward front left corner bridge 90L along second front corner-tab fold line 96L to cause first tab panel 94L1 to lie in confronting relation with second bridge panel 90L2 and second tab panel 94L2 to lie in confronting relation with first bridge panel 90L1. As a result, front end strip 42 is arranged to extend upwardly away from floor 14 and second bridge panel 90L2 is arranged to extend along left-side fold line 30. First bridge panel 90L1 is arranged to extend between and interconnect second bridge panel 90L2 and front end wall 13.

Left side closure 16 illustratively includes a left inner strip 54L coupled to floor 14 about left-side fold line 30 and a left outer anchor strip 56L coupled to left inner strip 54L about a left anchor-strip fold line 58L as shown in FIG. 3. Left inner strip 54L includes, for example, a left side wall 60L, a first left wall anchor flap 62L coupled to left side wall 60L about a first left wall flap fold line 64L, and a second left wall anchor flap 66L coupled to left side wall 60L about a second left wall flap fold line 68L as shown in FIG. 3. First left wall anchor flap 62L is used to establish first medial layer 222 of second quad-layer corner 22. First medial layer 222 of second quad-layer corner 22 is established during a subsequent stage of container forming as suggested in FIGS. 4-10.

During the subsequent stage of container forming, left side closure 16 is folded about left-side fold line 30 toward floor 14 so that left side wall 60L and first and second left wall anchor flap 62L, 66L extend upwardly away from floor 14. At the same time, first and second left wall anchor flaps 62L, 66L are folded inwardly toward floor 14 about associated left wall flap fold lines 64L, 68L. As an example, first left wall anchor flap 62L is arranged to extend away from left side wall 60L toward front end wall 13 and is coupled to first bridge panel 90L1 of front left corner bridge 90L and forms first medial layer 222.

Left outer anchor strip 56L includes a left canopy 70L, a first left primary canopy anchor flap 72L, a first left auxiliary canopy anchor flap 74L, a second left primary canopy anchor flap 76L, and a second left auxiliary canopy anchor flap 78L as shown in FIG. 3. Left canopy 70L is coupled to left side wall 60L about left anchor-strip fold line 58L. First left primary canopy anchor flap 72L is coupled to left canopy 70L by a first left primary flap fold line 80L. First left auxiliary canopy anchor flap 74L is coupled to first left primary canopy anchor flap 72L by a first left auxiliary flap fold line 84L as shown in FIG. 3. Second left primary canopy anchor flap 76L is coupled to left canopy 70L by a second left primary flap fold line 86L. Second left auxiliary canopy anchor flap 78L is coupled to second left primary canopy anchor flap 76L by a first left auxiliary flap fold line 88L as shown in FIG. 3. Outer layer 221 of second quad-layer corner 22 is established during the last stage of container forming.

During the last stage of container forming, left outer anchor strip 56L is folded about left anchor-strip fold line 58L toward floor 14 so that left canopy 70L is arranged to lie in spaced-apart parallel relation above floor 14 as shown in FIG. 2. At the same time, first left primary and auxiliary canopy anchor flaps 72L, 74L are folded downwardly about first left primary flap fold line 80L so that first left primary canopy anchor flap 72L extends downwardly and mates with front end wall 13 as suggested in FIG. 8 and shown in FIG. 9. Finally, second quad-layer corner 22 is established as a result of folding first left auxiliary canopy anchor flap 74L about first left auxiliary flap fold line 84L toward first left wall anchor flap 62L.

Second quad-layer corner 22 is established as a result of coupling first left wall anchor flap 62L to first bridge panel 90L1 of front left corner bridge 90L and by coupling first left auxiliary canopy anchor flap 74L to first left wall anchor flap 62L. As an example, first left wall anchor flap 62L is coupled to first bridge panel 90L1 by adhesive 98 as suggested in FIG. 7. First left auxiliary canopy anchor flap 74L is coupled to first left wall anchor flap 62L by adhesive 100 as suggested in FIGS. 8 and 9. While adhesive 98, 100 is shown as an example, any other suitable alternative may be used.

Rear end closure 18 illustratively includes a rear end strip 42R and a rear end canopy 43R coupled to rear end strip 42R about a rear end canopy fold line 43FR as shown in FIG. 3. Rear end strip 42R includes a rear end wall 15, a first rear anchor flap 46R coupled to rear end wall 15 about a rear anchor-flap fold line 48R, and a second rear anchor flap 50R coupled to rear end wall 15 about a second rear anchor-flap fold line 52R as shown in FIG. 3. First rear anchor flap 46R is positioned to lie in spaced-apart relation to second rear anchor flap 50R to locate rear end wall 15 therebetween. Portions of first rear anchor flap 46R are used to establish second medial layer 243 and inner layer 244 of fourth quad-layer corner 24. Similarly, portions of second rear anchor flap 50R are used to establish second medial layer 233 and inner layer 234 of third quad-layer corner 23.

First rear anchor flap 46R includes a rear right corner bridge 90R that is coupled to rear end wall 15 about a first rear anchor-flap fold line 48R and a rear right corner tab 94R that is coupled to rear right corner bridge 90R about a first rear corner-tab fold line 96R as shown in FIG. 3. Second medial layer 243 and inner layer 244 of fourth quad-layer corner 24 are established during an initial stage of container forming.

Rear right corner bride 90R includes a first bridge panel 901R and a second bridge panel 902R as shown, for example, in FIG. 3. First bridge panel 901R is coupled to rear end wall 15 by first rear anchor-flap fold line 48R. Second bridge panel 902R is coupled to first bridge panel 901R by a bridge-panel fold line 903R. Rear right corner tab 94R is coupled to second bridge panel 902R by first rear corner-tab fold line 96R. First bridge panel 901R establishes second medial layer 243 as shown in FIG. 2.

Rear right corner tab 94R includes a first tab panel 941R and a second tab panel 942R as shown in FIG. 3. First tab panel 941R is coupled to second bridge panel 902R by first rear corner-tab fold line 96R. Second tab panel 942R is coupled to first tab panel 941R by a tab-panel fold line 943R. Second tab panel 942R establishes inner layer 244 as shown in FIG. 2.

Second rear anchor flap 50R includes a rear left corner bridge 90LR that is coupled to rear end wall 15 about a second rear anchor-flap fold line 52R and a rear left corner tab 94LR that is coupled to rear left corner bridge 90LR about a second rear corner-tab fold line 96LR as shown in FIG. 3. Second medial layer 233 and inner layer 234 of third quad-layer corner 23 are established during the initial stage of container forming as suggested in FIGS. 4-10.

Rear left corner bride 90LR includes a first bridge panel 90L1R and a second bridge panel 90L2R as shown, for example, in FIG. 3. First bridge panel 90L1R is coupled to rear end wall 15 by second rear anchor-flap fold line 52R. Second bridge panel 90L2R is coupled to first bridge panel 90L1R by a bridge-panel fold line 90L3R. Rear left corner tab 94LR is coupled to second bridge panel 90L2R by second rear corner-tab fold line 96LR. First bridge panel 90L1R establishes second medial layer 233.

Rear left corner tab 94LR includes a first tab panel 94L1R and a second tab panel 94L2R as shown in FIG. 3. First tab panel 94L1R is coupled to second bridge panel 90L2R by second rear corner-tab fold line 96LR. Second tab panel 94L2R is coupled to first tab panel 94L1R by a tab-panel fold line 94L3R. Second tab panel 94L2R establishes inner layer 234 as shown in FIG. 2.

During the initial stage of container formation, rear end closure 18 is folded about rear-end fold line 34 toward floor 14. At the same time, rear left corner bridge 90LR is folded inwardly toward floor 14 about second rear anchor-flap fold line 52R and rear left corner tab 94LR is folded inwardly toward floor 14 about second rear corner-tab fold line 96LR. Next, rear left corner tab 94LR is folded back toward rear left corner bridge 90LR along second rear corner-tab fold line 96LR to cause first tab panel 94L1R to lie in confronting relation with second bridge panel 90L2R and second tab panel 94L2R to lie in confronting relation with first bridge panel 90L1R. As a result, rear end strip 42R is arranged to extend upwardly away from floor 14 and second bridge panel 90L2R is arranged to extend along left-side fold line 30. First bridge panel 90L1R is arranged to extend between and interconnect second bridge panel 90L2R and rear end wall 15.

During the subsequent stage of container forming, left side closure 16 is folded about left-side fold line 30 toward floor 14 so that left side wall 60L and first and second left wall anchor flap 62L, 66L extend upwardly away from floor 14. At the same time, first and second left wall anchor flaps 62L, 66L are folded inwardly toward floor 14 about associated left wall flap fold lines 64L, 68L. As an example, second left wall anchor flap 66L is arranged to extend away from left side wall 60L toward rear end wall 15 and is coupled to second bridge panel 90L1R of rear left corner bridge 90LR and forms first medial layer 232.

During the last stage of container forming, left outer anchor strip 56L is folded about left anchor-strip fold line 58L toward floor 14 so that left canopy 70L is arranged to lie in spaced-apart parallel relation above floor 14 as shown in FIG. 2. At the same time, second left primary and auxiliary canopy anchor flaps 76L, 78L are folded downwardly about first left primary flap fold line 86L so that first left primary canopy anchor flap 76L extends downwardly and mates with rear end wall 15 as suggested in FIG. 8 and shown in FIG. 9. Finally, third quad-layer corner 23 is established as a result of folding second left auxiliary canopy anchor flap 78L about second left auxiliary flap fold line 88L toward first left wall anchor flap 62L.

Third quad-layer corner 23 is established as a result of coupling second left wall anchor flap 66L to first bridge panel 90L1R of rear left corner bridge 90LR and by coupling second left auxiliary canopy anchor flap 78L to second left wall anchor flap 66L. As an example, second left wall anchor flap 66L is coupled to first bridge panel 90L1R by adhesive 98 as suggested in FIG. 7. Second left auxiliary canopy anchor flap 78L is coupled to second left wall anchor flap 66L by adhesive 100 as suggested in FIGS. 8 and 9. While adhesive 98, 100 is shown as an example, any other suitable alternative may be used.

Also during the initial stage of container formation, rear end closure 18 is folded about rear-end fold line 34 toward floor 14. At the same time, rear right corner bridge 90R is folded inwardly toward floor 14 about second rear anchor-flap fold line 52R and rear right corner tab 94R is folded inwardly toward floor 14 about first rear corner-tab fold line 96R. Next, first right corner tab 94R is folded back toward first right corner bridge 90R along first rear corner-tab fold line 96R to cause first tab panel 941R to lie in confronting relation with second bridge panel 902R and second tab panel 942R to lie in confronting relation with first bridge panel 901R. As a result, rear end strip 42R is arranged to extend upwardly away from floor 14 and second bridge panel 902R is arranged to extend along right-side fold line 32. First bridge panel 901R is arranged to extend between and interconnect second bridge panel 902R and rear end wall 15.

During the subsequent stage of container forming, right side closure 20 is folded about right-side fold line 32 toward floor 14 so that right side wall 60 and first and second right wall anchor flap 62, 66 extend upwardly away from floor 14. At the same time, first and second right wall anchor flaps 62, 66 are folded inwardly toward floor 14 about associated right wall flap fold lines 64, 68. As an example, second right wall anchor flap 66 is arranged to extend away from right side wall 60 toward rear end wall 15 and is coupled to second bridge panel 901R of rear right corner bridge 90R and forms first medial layer 242.

During the last stage of container forming, right outer anchor strip 56 is folded about right anchor-strip fold line 58 toward floor 14 so that right canopy 70 is arranged to lie in spaced-apart parallel relation above floor 14 as shown in FIG. 2. At the same time, second right primary and auxiliary canopy anchor flaps 76, 78 are folded downwardly about second right primary flap fold line 86 so that first right primary canopy anchor flap 76 extends downwardly and mates with rear end wall 15 as suggested in FIG. 8 and shown in FIG. 9. Finally, fourth quad-layer corner 24 is established as a result of folding second right auxiliary canopy anchor flap 78 about second right auxiliary flap fold line 88 toward first right wall anchor flap 66.

Fourth quad-layer corner 24 is established as a result of coupling second right wall anchor flap 66 to first bridge panel 901R of rear right corner bridge 90R and by coupling second right auxiliary canopy anchor flap 78 to second right wall anchor flap 66. As an example, second right wall anchor flap 66 is coupled to first bridge panel 901R by adhesive 98 as suggested in FIG. 7. Second right auxiliary canopy anchor flap 78 is coupled to second right wall anchor flap 66 by adhesive 100 as suggested in FIGS. 8 and 9. While adhesive 98, 100 is shown as an example, any other suitable alternative may be used.

A blank 228 made of corrugated material in accordance with a second embodiment of the present disclosure is shown in FIG. 11 and can be assembled as suggested in FIG. 112 to produce a first quad-layer corner 221A of a container 210 as shown in FIG. 12. In most respects, blank 228 is similar to blank 28 of FIG. 3.

Blank 228 is formed during an illustrative blank forming process, for example in a manufacturing facility. During the blank forming process, a corrugated sheet is processed to establish blank 228 and scrap which separated from blank 228. During blank forming, first right wall anchor flap 262 is formed to have a proximal end 262P and a distal end 262D which is spaced-apart from proximal end 262P. First right wall anchor flap 262 is appended to right side wall 60 along first right wall flap fold line 64 by proximal end 262P. As shown in FIG. 11, first right wall anchor flap 262 extends away from first right wall flap fold line 64 toward first front anchor flap 46 and first right auxiliary canopy anchor flap 74 such that distal end 262D is spaced apart from first front anchor flap 46 and first right auxiliary canopy anchor flap 74.

During the blank forming process which may be performed in a manufacturing facility, scrap is separated from blank 228 which causes two triangle-shaped apertures 120A, 120B and an interconnecting rectangle-shaped aperture 120C to be formed therein. As a result of the scrap piece being monolithic, it simplifies removal and separation from blank 228. Another result of distal end 262D being spaced apart from first front anchor flap 46 and first right auxiliary canopy anchor flap 74 is that rectangle-shaped aperture 120C is formed by removing scrap. Container forming is simplified as a result of distal end 262D of first right wall anchor flap 262 being spaced-apart from first front anchor flap 46 and first right auxiliary canopy anchor flap 74 is that friction between distal end 262D of and first front anchor flap 46 and first right auxiliary canopy anchor flap 74 is eliminated. Because friction has been eliminated, the likelihood of forming improperly formed containers is minimized.

Figure 10:
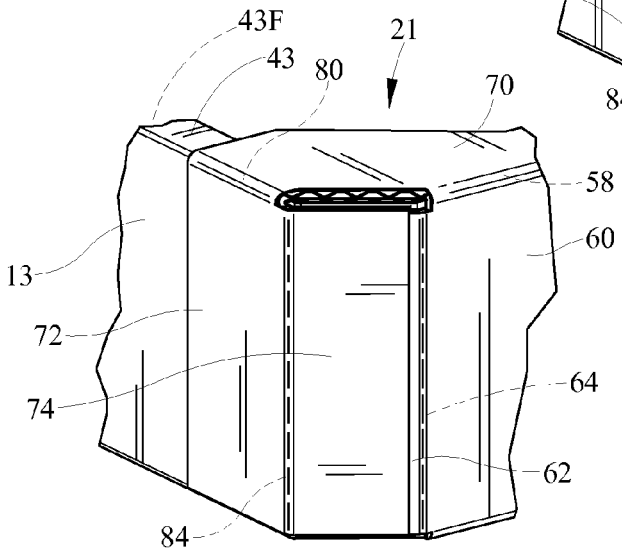

Blank 228 includes floor 14, a right side closure 220 appended to floor 14 along right-side fold line 32, and a front end closure 12 appended to floor 14 along front-end fold line 36 as shown in FIG. 10. Right side closure 220 and front end closure 12 are configured to be folded in a manner similar to that shown in FIGS. 4-9 to produce first quad-layer corner 221A.

As discussed previously, first quad-layer corner 221A is similar to first quad-layer corner 21 except first medial layer 2212A is different. As shown in FIG. 2, first medial layer 212 of first quad-layer corner 21 has a first length 150. As shown in FIG. 13, first medial layer 2212A has a relatively smaller second length 250.

In an illustrative embodiment, the corrugation of blank 228 is positioned to run in a transverse direction TD as shown in insert A in FIG. 11. As a result, outer layer 2211A, second medial layer 2213A, and inner layer 2214A has corrugation which runs vertically as shown in FIG. 13 after container 210 has been formed. First medial layer 2212A has corrugation which runs horizontally as shown in FIG. 11 after container 210 has been formed. In one illustrative example, it was found surprisingly that the medial layer 2212A of quad-layer corner 221A increases stacking strength of container 210. Stacking strength may be measured using standard industry test methods. As an example, stacking strength may be evaluated using the TSL-8.2-WI-005 test method and procedure reference T804 of the Technical Association of the Pulp and Paper Industry (TAPPI).

In another embodiment, the right canopy and the left canopy may be configured so as to establish a lid after the container has been formed. In an example, the right canopy has a width about equal to one half a width of the floor and the left canopy has a width about equal to one half the width of the floor. After the container has been erected, the right canopy is folded inwardly toward the floor about the right anchor-strip fold line so that the right canopy lies above the floor and extends away from the right side wall toward the left sidewall. The left canopy is also folded inwardly toward the floor about the left anchor-strip fold line so that the left canopy lies above the floor and extends away from the left side wall toward the right side wall. As a result, the interior region is defined by the floor, the right side closure, the left side closure, the front end wall, the rear end wall, the four quad-layer corners, and the lid established upon completion of forming the container. In another embodiment, a container may omit a front canopy and a rear canopy.

What is claimed is:

1. An article-transport container comprising:

a floor having a respective left-side and right-side closures foldably joined thereto, the right side closure includes a right inner strip coupled to the floor about a right-side fold line and a right outer anchor strip is coupled to the right inner strip about a right anchor-strip fold line, a front end closure foldably joined to the floor and to the respective right-side and left-side closures, a rear end closure foldably joined to the floor and to the respective right-side and left-side closures, and at least one quad-layer corner cooperate with the respective right-side and left-side closures to define an interior region adapted to receive articles therein wherein the least one quad-layer corner includes respective outer and inner layers and respective first and second medial layers being sandwiched between the respective outer and inner layers to enhance stacking strength of the container while minimizing scarps produced during construction of the container.

2. The container of claim 1 wherein the at least one quad-layer corner includes four quad-layer corners defined by a first quad-layer corner, a second quad-layer corner, a third quad-layer corner, and a fourth quad-layer corner.

3. The container of claim 1 wherein the outer layer is formed from a portion of the right side closure and the first medial layer is formed from another portion of the right side closure.

4. The container of claim 1 wherein the second medial portion is formed from a portion of the front end closure and the inner layer is formed from another portion of the front end closure.

5. The container of claim 1 wherein the first medial layer is positioned to lie between the outer and second medial layers and is configured to provide means for interconnecting the outer layer and the second medial layer.

6. The container of claim 1 wherein the second medial layer is positioned to lie between the first medial layer and the inner layer.

7. The container of claim 1 wherein the respective right side and left side closures includes a corresponding right canopy and a corresponding left canopy wherein each of which is overlying the floor.

8. The container of claim 1 wherein the front end closure further includes a front end strip and a front end canopy coupled to the front end strip about a front end canopy fold line wherein the front end strip includes a front end wall, a first front anchor flap coupled to the front end wall about a first front anchor-flap fold line and a second front anchor flap coupled to the front end wall about a second front anchor-flap fold line.

9. The container of claim 8 wherein the first front anchor flap includes a front right corner bridge that is coupled to front end wall about a first front anchor-flap fold line and a front right corner tab that is coupled to the front right corner bridge about a first front corner-tab fold line.

10. The container of claim 9 wherein the front right corner tab includes a first tab panel and a second tab panel wherein the first tab panel is coupled to a second bridge panel by a first front corner-tab fold line and the second tab panel is coupled to the first tab panel by a first tab-panel fold line.

11. The container of claim 1 wherein the right inner strip (54) includes a right side wall (60), a first right wall anchor flap (62) coupled to the right side wall about a first right wall flap fold line (64), and a second right wall anchor flap (66) is coupled to the right side wall about a second right wall flap fold line.

12. The container of claim 11 wherein the first right wall anchor flap is used to establish the first medial layer of first quad-layer corner.

13. An article-transport container comprising:

a floor having a respective left-side and right-side closures foldably joined thereto, a front end closure foldably joined to the floor and to the respective right-side and left-side closures, a rear end closure foldably joined to the floor and to the respective right-side and left-side closures, and four quad-layer corners defined by a first quad-layer corner, a second quad-layer corner, a third quad-layer corner, and a fourth quad-layer corner cooperate with the respective right-side and left-side closures to define an interior region adapted to receive articles therein, the first quad-layer corner being arranged to extent between a front end wall a and right side wall and lie at an acute angle relative to the front end wall wherein the acute angle is defined to be between a first mitered edge of the floor and a front end edge of floor and wherein the first quad-layer corner includes respective outer and inner layers and respective first and second medial layers being sandwiched between the respective outer and inner layers to enhance stacking strength of the container while minimizing scarps produced during construction of the container.

14. The container of claim 13 wherein the second quad-layer corner (22) is established as a result of coupling a first left wall anchor flap (62L) to a first bridge panel (90L1) of a front left corner bridge (90L) and by coupling first left auxiliary canopy anchor flap (74L) to the first left wall anchor flap (62L).

15. A blank (28) for making an article-transport container comprising:

A floor (14), a left side closure (16) being appended to floor (14) along a left-side fold line (30), a right side closure (20) being appended to floor (14) along a right-side fold line (32), a rear end closure (18) being appended to floor (14) along a rear-end fold line (34), and a front end closure (12) being appended to floor (14) along a front-end fold line (36), the front end closure includes a front end strip and a front end canopy coupled to the front end strip about a front end canopy fold line wherein the front end strip includes a front end wall, a first front anchor flap coupled to the front end wall about a first front anchor-flap fold line and a second front anchor flap coupled to the front end wall about a second front anchor-flap fold line and wherein the right side closure (20), the left side closure (16), the rear end closure (18), the front end closure (12), and four quad-layer corners (21), (22), (23), (24) cooperate with one another to form a border coupled to the floor (14) and arranged to cooperate with the floor (14) to define interior region (26) of container (10).

16. The blank (28) of claim 15 wherein the rear end closure (18) cooperates with the left side closure (16) and the right side closure (20) to establish a rear end (38) of container (10).

* * * * *

UNITED STATES PATENT AND TRADEMARK OFFICE

CERTIFICATE OF CORRECTION

PATENT NO. : 8,800,850 B2
APPLICATION NO. : 14/037515
DATED : August 12, 2014
INVENTOR(S) : McLeod It is certified that error appears in the above-identified patent and that said Letters Patent is hereby corrected as shown below:

Title Page

Item (73) Assignee: Should read -- TIN Inc. --.

Signed and Sealed this
Twenty-first Day of October, 2014

Michelle K. Lee

Michelle K. Lee
*Deputy Director of the United States Patent and Trademark Office*